United States Patent [19]

Ford

[11] 4,240,490

[45] Dec. 23, 1980

[54] SHADE FOR RECREATIONAL VEHICLE

[75] Inventor: Alan A. Ford, Irvine, Calif.

[73] Assignee: Kirsch Company, Sturgis, Mich.

[21] Appl. No.: 18,298

[22] Filed: Mar. 7, 1979

[51] Int. Cl.[3] ..... E06B 9/08

[52] U.S. Cl. ..... 160/133; 160/38

[58] Field of Search ..... 160/19, 38, 84 R, 39, 160/133, 237, 23 C; 135/14 D, 5 AT

[56] References Cited

U.S. PATENT DOCUMENTS

| | | | |
|---|---|---|---|
| 134,862 | 1/1873 | Donnell | 160/84 R |
| 922,069 | 5/1909 | Walsh | 135/14 R |
| 1,187,648 | 6/1916 | Perry | 160/23 C |
| 3,011,824 | 12/1961 | Vassallo et al. | 160/237 |
| 3,124,195 | 3/1964 | Anderson | 160/133 |
| 3,246,685 | 4/1966 | Anderson et al. | 160/133 |
| 3,682,225 | 8/1972 | Redden | 135/14 D |
| 3,826,271 | 7/1974 | Sattler et al. | 135/5 AT |

*Primary Examiner*—Peter M. Caun

*Attorney, Agent, or Firm*—Blanchard, Flynn, Thiel, Boutell & Tanis

[57] ABSTRACT

An inexpensive but easily operable window shade, as for use in a recreational vehicle. A substantially rigid mounting bar has fabric comprising a shade hanging a desired distance from one side thereof and a valance hanging a lesser distance from the other side thereof. The fabric may, for example, be woven wood. Interengageable means, such as snap buttons or "Velcro", are affixed to said valance and to the shade for separably securing them together when said shade is in a desired raised position.

10 Claims, 6 Drawing Figures

SHADE FOR RECREATIONAL VEHICLE

FIELD OF THE INVENTION

The invention relates to shade means for a window and particularly to shade means having both an attractive appearance and capacity for being lifted into a partially or fully raised position by interengageable means involving such little expense as to make the shade means economically adaptable to recreational vehicle use.

BACKGROUND OF THE INVENTION

In the art of window shading and/or decorating, there has long been recognized an area in which it is desirable to shade or otherwise cover a window by desirably decorative means, such as woven wood fabric, together with providing means for holding said shade in a partially or fully raised position which latter means are of such nature that they can be provided at a sufficiently minor expense as to make the assembly adaptable for use in such locations as recreational vehicles, summer cottages, mountain cabins, or the like. This problem is not confined to, but it becomes particularly acute when, the fabric which it is desired to use for the window covering and/or decorating is that which is sometimes described as slatted blinds or woven wood comprising a plurality of rods or slats connected by interwoven cords or tape.

This type of blind has been known for a long time and it has conventionally been provided with cords to roll same upwardly into whatever lifted position is desired. This system has worked satisfactorily but the necessary provision therein for pulleys and cords adds a substantial increment of expense over that of the fabric and makes this type of shade economically impractical for uses such as the type of uses above mentioned. Nevertheless there is a substantial market in the uses named if inexpensive but effective means can be found for lifting the shade quickly and easily and securing it in a desired lifted position.

Therefore, the objects of the invention include:

1. To provide means for holding a window shade, particularly of the slatted blind or taped slats type, in a fully or partially lifted position, which means can be provided at a very small increment of cost beyond that of the shade fabric itself and which means will still be easy both to understand and to use.

2. To provide means, as aforesaid, which will not materially, if at all, damage the appearance of said shade in any position thereof.

3. To provide means, as aforesaid, which will provide for a plurality of lifted positions as desired.

4. To provide means, as aforesaid, wherein the mode of operation will be obvious upon inspection of a given shade or at most will be readily comprehended with only minimum of explanation.

5. To provide apparatus, as aforesaid, in which the shade may be returned from a lifted to a lowered position quickly and easily.

6. To provide means, as aforesaid, which will be capable of a long life of trouble-free operation.

Other objects and purposes of the invention will be apparent to persons acquainted with apparatus of this general sort upon reading the following specification and inspection of the accompanying drawings.

SUMMARY OF THE INVENTION

Figure 1:
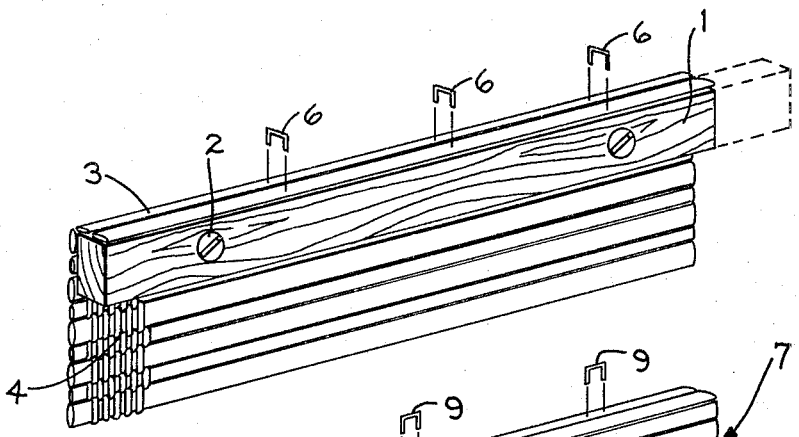
FIG. 1 is an oblique fragmentary view of a mounting bar with shade fabric fixed thereto and hanging therefrom.
Figure 2:
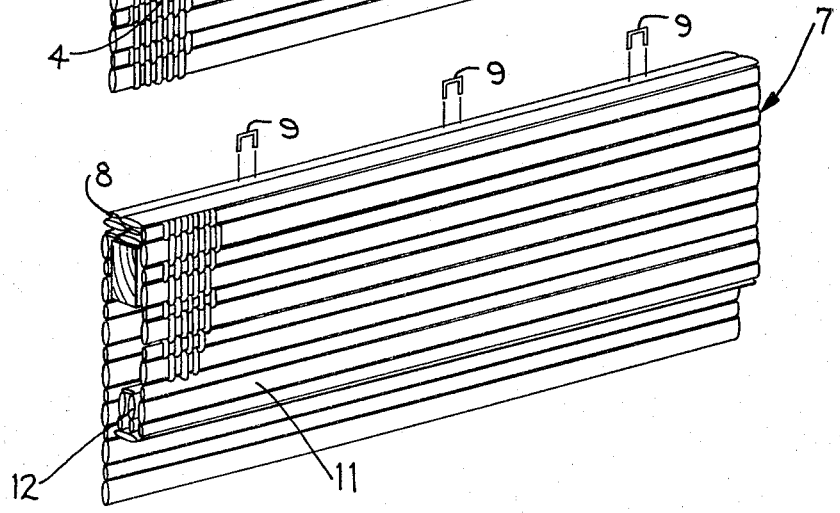
FIG. 2 is an oblique view similar to that of FIG. 1 with a valance added thereto.

Briefly, the invention contemplates a substantially rigid mounting bar with the shade fabric hanging from one side thereof and fabric constituting a valance hanging from the other side thereof. Interengageable means are fixed to a lower portion of the valance and to selected portions of the shade whereby the shade may be lifted to the extent desired and its interengageable means interengaged with the interengageable means on the valance for holding said shade in the desired raised position. Such interengageable means may advantageously be the product known under the trademark "Velcro", snap buttons, or other similar means as desired.

DETAILED DESCRIPTION

Looking now at the drawings, it will be noted that same illustrate both the shade and the valance as being made from a taped slat, or slatted blind, material and it is primarily for this type of material that the invention is intended. However, it will be recognized that such use is here only illustrative and that the invention will be applicable to a wide range of fabrics, particularly fabrics which are sufficiently transversely stiff of themselves, or are provided with transverse stiffening elements, as to be capable of rolling or folding in the manner hereinafter set forth.

There is provided first a relatively heavy headrail 1 which is of length to span the window opening as desired and which may be mounted onto, or within, the window frame in any convenient manner. For example, screw means as indicated at 2 may be provided extending through said headrail into the window frame or wall above the window or a portion of said headrail may be extended as indicated at 1A for reception by any convenient wall or window frame mounted bracket (not shown). Folded over the top of the headrail 1 is a portion 3 of the taped slat fabric 4, same being fastened thereto in any convenient manner, such as by an adhesive or by staples, as gun-inserted staples, 6. The fabric 4 will hang down whatever distance may be desired for covering the window and will preferably terminate at its lower edge with a folded-back hem which is likewise held in position as convenient, such as by staples.

The valance 7 includes a single folded hem 8 at its upper edge which is positioned above the portion 3 of the shade fabric and fixed thereto as convenient, such as by further gun-inserted staples 9. The lower edge 11 of the valance is finished by a double-folded hem 12 which is held in position in any convenient manner such as by an adhesive or by staples (not shown).

The structure as thus far described provides an extremely inexpensive shade mounting having an attractive valance comprising the same material as the shade suitably finished and trimmed at both top and bottom and mountable in front of a window by extremely simple means such as a bracket or such as screws passing directly through the headrail.

Figure 3:
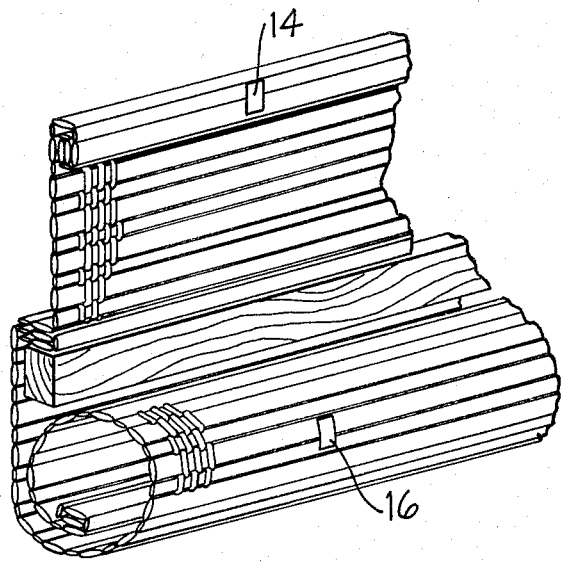
FIG. 3 is an oblique view similar to that of FIG. 1 showing the shade rolled into its uppermost position and showing the valance lifted to reveal the fastening means by which the valance engages the rolled shade for holding same in a rolled-up position.
Figure 4:
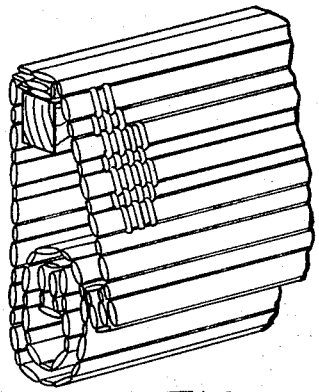
FIG. 4 is an oblique view showing the shade rolled into its fully lifted position and the valance in holding position with respect thereto.

Turning now to the means for holding such shade in a lifted position, there is shown in FIG. 3 the provision of first hook means, here micro-hook means such as the material sold under the trademark "Velcro". Such first hook means are fastened to the lower hem of the valance and fastened on the normally hidden side thereof so as not to be visible from the room within which the shade is being used.

There is also affixed on the outside (outside with respect to the room within which the shade is being used) of the shade fabric a cooperating second hook member 16 so positioned with respect to the first hook member 14 that when the shade is rolled into a fully raised condition, the first and second hook members may be caused to interengage upon lowering of the valance against the shade and the valance will then act as a retainer for holding the shade in its fully raised position. Since the valance will be in its normal downwardly hanging position as shown in FIG. 3, it will retain its normal appearance and the shade will simply be rolled up behind it. Thus, the shade will be out of the way, will be at least partially hidden behind the valance and the valance will be in its normal position.

Figure 5:
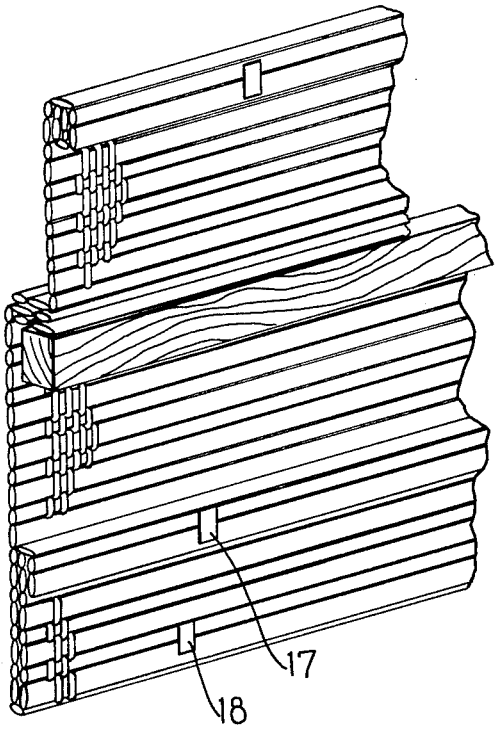
FIG. 5 is a view generally similar to that of FIG. 3 in which holding means are fastened near the lower edge of the shade for cooperating with the portion of the holding means mounted on the valance for holding the shade in a partially raised position.

If it is desired to raise the shade only partway, there may be provided third hook means 17 on the outside surface of the lower hem as shown in FIG. 5 which when lifted and interconnected with the first hook means 14 will hold the shade in a partially raised position.

Figure 6:
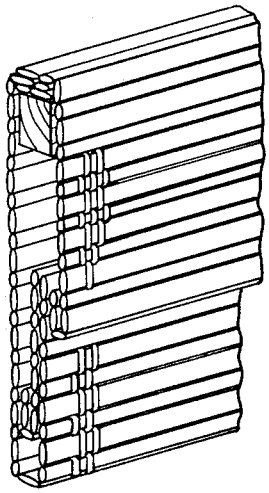
FIG. 6 is a schematic view showing the valance holding the shade in a further or second partially raised position.

Further variations of this will, of course, be possible such as positioning a still further hook means 18 in a position intermediate the second and third hook means 16 and 17 so that the shade may be raised, for example, ¾ of the way. In such case, the portion of the shade between the further hook means 18 and the third hook means 17 will be folded back upon itself and the remainder of the shade will hang from the hook means 18 as indicated schematically in FIG. 6.

Other arrangements will in an extension of the foregoing, be available according to the desire of the user and the expense which can be accepted.

It will be recognized that a variety of interengaging means, including snap buttons, can be used in place of the "Velcro" if desired providing only same are inexpensive and easily operable for interengagement and disengagement.

If the foregoing system is utilized with a cloth fabric, it may be dealt with in the same manner as above described but normally a stiffening element will be inserted into a suitable hem at the lower edge of the shade and a further stiffening element similarly provided at the lower edge of the valance.

Although a particular preferred embodiment of the invention has been disclosed in detail for illustrative purposes, it will be recognized that variations or modifications of the disclosed apparatus, including the rearrangement of parts, lie within the scope of the present invention. For example, while woven wood fabric is specifically mentioned herein, other fabrics may be used.

The embodiments of the invention in which an exclusive property or privilege is claimed are defined as follows:

1. A window shade arrangement and means for holding same in a selected lifted position comprising:

a headrail;

a shade comprising a flexible fabric having its upper edge fixed to said headrail;

a valance likewise comprising a flexible fabric and having its upper edge fixed to said headrail;

interengageable means comprising two portions, one such portion being affixed to the lower edge of said valance and the other such portion being affixed to said shade.

2. The device of claim 1 having stiffening means along the bottom edge of said valance.

3. The device of claim 1 having stiffening means along the bottom edge of said shade.

4. The shade of claim 2 wherein said fabric is a taped slat structure and said stiffening means is a folded-over hem.

5. The device of claim 1 wherein the portion of said interengageable means fixed to said valance is adjacent the lower edge thereof and on the side of said valance facing said shade.

6. The device of claim 1 wherein said shade and said valance are positioned on opposite sides of said headrail.

7. The device of claim 1 wherein said other portion of said interengageable means is fixed adjacent the lower edge of said shade; and wherein said interengageable means comprises pieces of "Velcro".

8. The device of claim 1 wherein said other portion of said interengageable means is fixed to said shade on the surface thereof remote from said valance and at a point thereon intermediate the lower edge thereof and the upper edge thereof, whereby said shade must be rolled inwardly upon itself to enable the lower edge of said valance to engage the two portions of said interengageable means.

9. A window shade, comprising:

rigid headrail means;

a panel of flexible fabric secured to said headrail means along a line spaced from two edges of said panel whereby to form a shade portion and a relatively short valance portion, both arranged for depending from said headrail means;

interengageable means having a first part secured to said valance part and a second portion secured to said shade portion for releasably holding said shade portion in a raised position.

10. A shade according to claim 9 wherein said panel is substantially rectangular and made from fabric having wooden slats held in parallel relationship by textile elements interwoven with said wooden slats; and wherein said second part of said interengageable means is secured to said shade portion a plural distance from said headrail.

* * * * *